US006837400B2

(12) United States Patent
Leoncavallo et al.

(10) Patent No.: US 6,837,400 B2
(45) Date of Patent: Jan. 4, 2005

(54) SOLVENT IDENTIFICATION BOTTLE WITH ADJUSTABLE DISPENSING FEATURE

(75) Inventors: Richard A. Leoncavallo, Niagara Falls, NY (US); John D. DeLorme, Spencerport, NY (US)

(73) Assignee: Nalge Nunc International Corporation, Rochester, NY (US)

( * ) Notice: Subject to any disclaimer, the term of this patent is extended or adjusted under 35 U.S.C. 154(b) by 0 days.

(21) Appl. No.: 10/384,117

(22) Filed: Mar. 7, 2003

(65) Prior Publication Data

US 2004/0173636 A1 Sep. 9, 2004

(51) Int. Cl.[7] ..... B67D 5/58

(52) U.S. Cl. ..... 222/189.09; 222/211; 222/212; 222/464.1; 215/308

(58) Field of Search ..... 222/189.09, 189.1, 222/211, 212, 464.1; 215/308

(56) References Cited

U.S. PATENT DOCUMENTS

| | | | | |
|---|---|---|---|---|
| 2,425,710 A | | 8/1947 | Bucknam et al. | 158/27.4 |
| 2,531,745 A | | 11/1950 | Schopmeyer | 299/99 |
| 2,578,907 A | | 12/1951 | Tupper | 299/90 |
| 2,687,227 A | | 8/1954 | Guth | 215/3 |
| 3,176,883 A | | 4/1965 | Davis, Jr. | 222/193 |
| 4,245,788 A | | 1/1981 | Wright | 239/327 |
| 4,383,622 A | | 5/1983 | Guth | 222/209 |
| 4,533,068 A | * | 8/1985 | Meierhoefer | 222/189.09 |
| 4,557,401 A | | 12/1985 | Hodge | 222/211 |
| 4,618,065 A | | 10/1986 | Guth | 215/3 |
| 5,054,657 A | * | 10/1991 | Morse et al. | 222/162 |
| 5,125,543 A | | 6/1992 | Rohrabacher et al. | 222/211 |
| 5,232,600 A | * | 8/1993 | Degen et al. | 210/840 |
| 5,529,223 A | | 6/1996 | Fisher | 222/211 |
| 5,577,625 A | | 11/1996 | Baird et al. | 215/235 |
| 5,605,257 A | * | 2/1997 | Beard | 222/189.09 |
| 5,882,454 A | | 3/1999 | Baginski et al. | |
| 6,030,558 A | | 2/2000 | Smith et al. | 264/41 |
| 6,058,636 A | * | 5/2000 | Colkmire | 40/630 |
| 6,073,812 A | | 6/2000 | Wade et al. | |
| 6,131,775 A | | 10/2000 | Brody | 222/211 |
| 6,398,048 B1 | | 6/2002 | Kevorkian | |
| 2002/0092858 A1 | | 7/2002 | Bowman | |

FOREIGN PATENT DOCUMENTS

| | | |
|---|---|---|
| EP | 0379047 | 7/1990 |
| WO | 03101858 | 12/2003 |

* cited by examiner

*Primary Examiner*—J. Casimer Jacyna
(74) *Attorney, Agent, or Firm*—Wood, Herron & Evans, L.L.P.

(57) ABSTRACT

An improvement to a bottle for storing, identifying, and dispensing liquids comprises a valve-type nozzle coupled to the outer end of the tube, a vent, and an optional identification tag. The valve-type nozzle is adjustable along a continuous range between open and closed conditions to permit dispensing of fluid in a controlled fashion and sealing of the container.

18 Claims, 3 Drawing Sheets

SOLVENT IDENTIFICATION BOTTLE WITH ADJUSTABLE DISPENSING FEATURE

FIELD OF THE INVENTION

The present invention pertains to containers for storing, identifying, and dispensing liquids, and more particularly to a wash bottle for storing, identifying, and dispensing volatile, aggressive, and/or high-purity solvents.

BACKGROUND OF THE INVENTION

Wash bottles and other containers constructed from flexible materials have found wide-spread use in laboratory and similar environments, wherein the flexible construction of the container permits dispensing of the liquid contents of the container by squeezing its sides. Typically, such bottles are provided with an elongate expulsion tube that extends from within the bottle to outside the bottle and which may terminate in a tapered cone-shape to help direct the flow of liquid discharged therefrom when the bottle is squeezed. The portion of the expulsion tube that extends outside the bottle is frequently bent to facilitate directing the stream of liquid to a desired area.

Often such bottles are constructed from flexible, solvent-resistant materials and used to store, identify and dispense volatile, aggressive, or high-purity solvents or chemicals. Because volatile liquids form vapors that increase the pressure within the container, a pressure differential is created between the inside and the outside of the bottle, causing the volatile solvent in the container to flow through the expulsion tube to equalize the inside and outside pressures. Also, an open expulsion tube is susceptible to leaking aggressive solvents in the event the bottle is tipped or knocked over. Further, moisture from ambient air can mix with high-purity solvents, affecting the quality and characteristics of the solvent. Accordingly, it is generally desirable to provide a closure for sealing the outlet of the tube to prevent dripping or expulsion of volatile, aggressive, and/or high-purity solvents through the tube in response to increased pressure within the bottle or to tipping of the bottle. Conventional wash bottles have used caps, clamps, or plugs to close the expulsion tube, but such devices are hazardous when storing volatile solvents that cause increased internal pressure because the mere act of touching the bottle in preparation for use can cause the cap or plug to leave the tube in a projectile fashion and/or can lead to nearly explosive discharge of the solvent contained within the bottle when the closing device is removed.

Accordingly, wash bottles for storing, identifying and dispensing volatile liquids must also be provided with a vent to help maintain pressure equilibrium between the interior of the bottle and the surrounding environment during times when the expulsion tube is blocked or closed. Conventional bottles utilize vents consisting of check valves to help equalize pressure created by the storage of volatile liquids. However, mechanical check valves are generally more labor intensive to incorporate, requiring additional supporting or restraining structure which increase the complexity of the bottle. Furthermore, mechanical check valves are susceptible to blockage or gumming up, which degrades performance.

Another drawback of conventional bottles used to store, identify, and dispense solvents and other chemicals is that the material forming the bottle, while resistant to the solvents and chemicals stored within the bottle, is often difficult to mark to thereby indicate the contents of the bottle.

Specifically, materials which are resistant to solvents and chemicals generally tend to resist marking with inks and do not provide suitable surfaces for applying adhesive identification labels. One solution to overcome this marking problem has been to attach tags to the container with wire. However, such tags often interfere with the handling of the bottles by users.

Accordingly, there is a need for a wash bottle that can be used to store, identify, and dispense solvents and other volatile, aggressive or high-purity liquids which overcomes drawbacks of the prior art, such as those described above.

SUMMARY OF THE INVENTION

The present invention provides a bottle with a unique valve-type nozzle and vent for storing, identifying and dispensing liquids, particularly volatile, aggressive, and/or high-purity solvents. The bottle comprises a container with flexible sidewalls that facilitate dispensing the liquid by squeezing the container. A closure for the bottle has an aperture sized to sealingly receive an elongate expulsion tube that has an inner end extending into the bottle and an outer end extending from the bottle to direct the flow of liquid. A gas-permeable membrane plug disposed within a vent port, is provided within the structure, for example, in the body of the container, in the closure or elsewhere, whereby increased pressure within the bottle may be vented to the outside.

In another aspect of the invention, a valve-type nozzle for dispensing fluid from a reservoir includes a first member coupled to the expulsion tube and a second member coupled to the first member for selective relative movement to place the nozzle in an open position or a closed position, or adjustably in between the fully open and fully closed positions, to permit regulation of solvent flow during dispensing. The first member has a first fluid passage with an inlet port in communication with the fluid reservoir and an orifice, whereby fluid from the reservoir can flow through the inlet port, through the first fluid passage, and out the orifice. The second member has a second fluid passage with an inlet and an outlet. The inlet of the second member is configured to receive the orifice of the first member. Selective relative movement of the first and second members moves a plug on the first member into and out of sealing engagement with a converging interior wall of the second member to thereby close and open the nozzle to adjustable degrees to vary the flow of liquid.

Advantageously, the valve may be closed to prevent unwanted leakage of volatile or aggressive liquids stored in the container, while the vent prevents the build-up of vapor pressure within the sealed bottle.

In another aspect of the invention, the container, closure, valve-type nozzle and vent plug material are formed from fluoropolymer materials, whereby the bottle is resistant to solvents or liquid chemicals stored therein.

In yet another aspect of the invention, a tag for identifying the contents of the bottle is included. The tag provides a marking surface which is adapted to receive ink or adhesive labels thereupon, and includes a connecting member for coupling the tag to the container. Further, tags can be provided in colors in conformance to industry standards.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
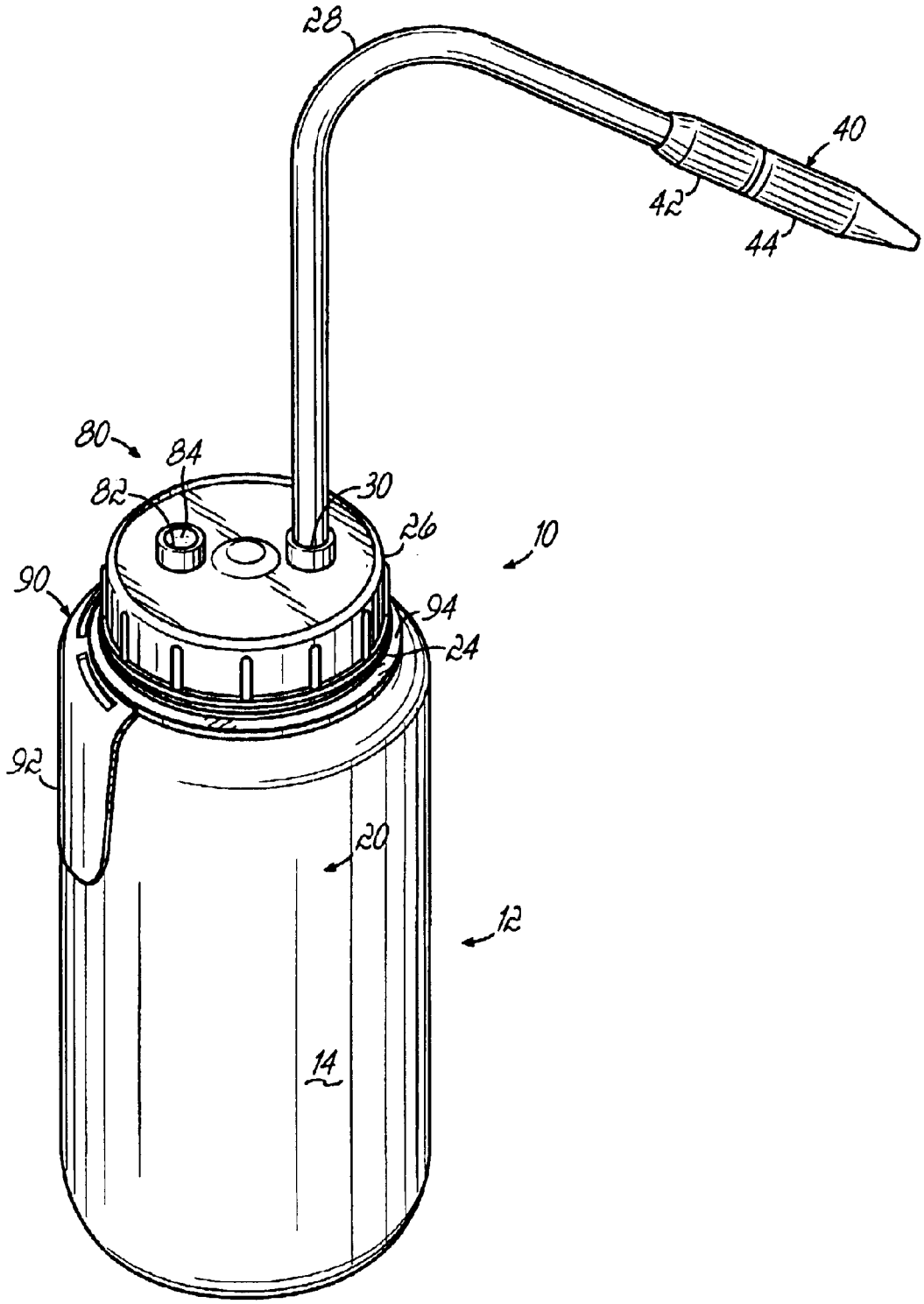
FIG. 1 is a perspective view depicting an exemplary bottle of the present invention.
Figure 2:
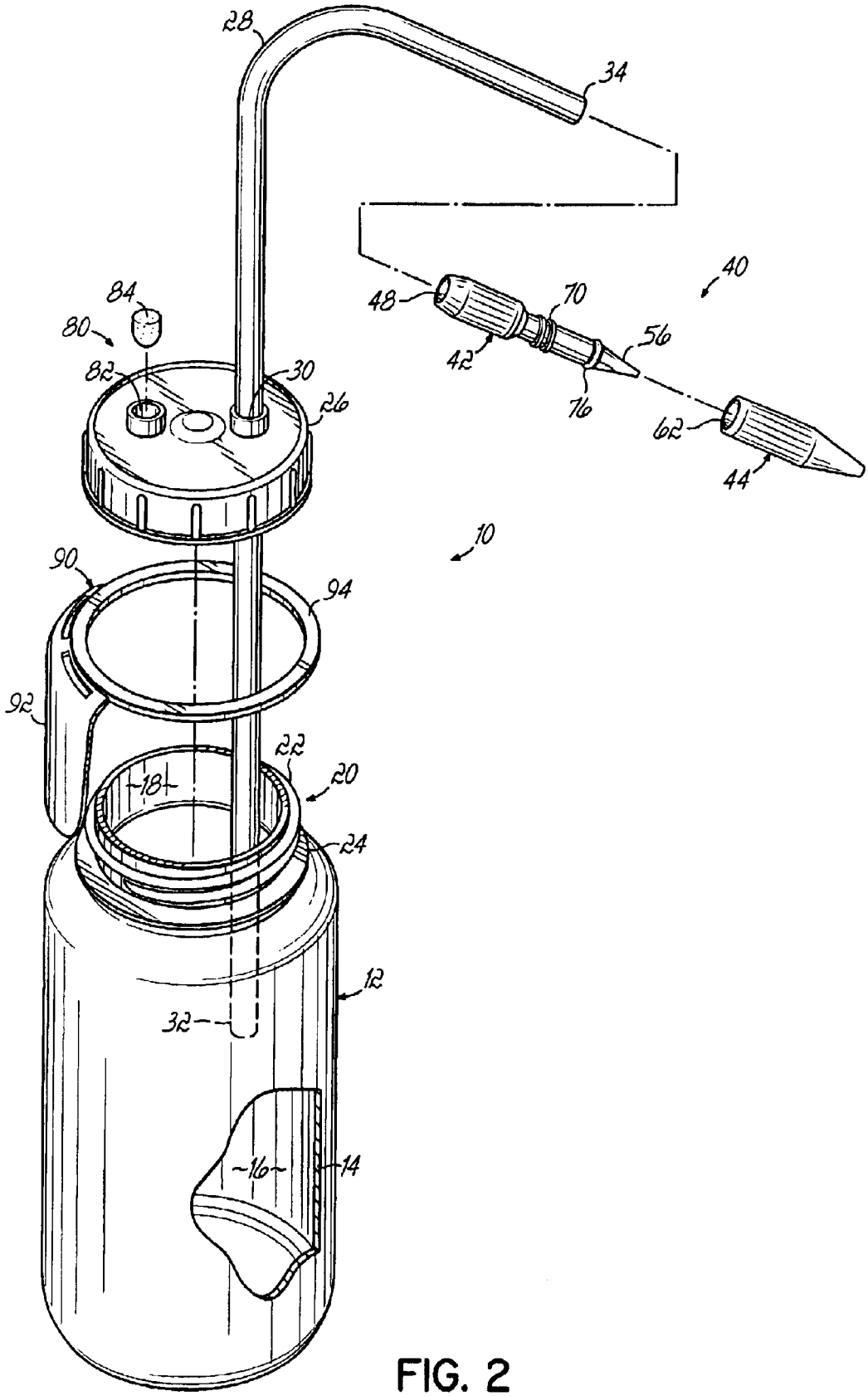
FIG. 2 is an exploded perspective view of the bottle of FIG. 1.

Referring to FIGS. 1 and 2, there is shown an exemplary bottle 10 of the present invention for storing, identifying and dispensing liquid materials. As shown most clearly in FIG. 2, the bottle comprises a container 12 having flexible sidewalls 14 defining an interior reservoir 16 for storing liquid materials. The container 12 has an open end 18 for providing access to the interior reservoir 16. In the exemplary embodiment shown, the open end 18 of the container 12 includes a neck 20 having threads 22 provided on an exterior surface of the container 12 proximate the open end 18, and a retaining lip or collar 24 positioned adjacent the threads 22. The bottle 10 further includes a closure 26, depicted in the exemplary embodiment as a screw-type cap having internal threads (not shown) configured to threadably engage the threads 22 on the open end 18 of the container 12.

The bottle 10 also includes an elongate tube 28 that facilitates dispensing liquids from the interior reservoir 16. Tube 28 is sealingly received through an aperture 30 formed in closure 26 such that an inner end 32 of the tube 28 is in communication with the interior reservoir 16 and an outer end 34 of the tube 28 is positioned exteriorly of the container 12 and closure 26. In the exemplary embodiment shown, the tube 28 is configured such that the inner end 32 of the tube 28 extends to the bottom-most portion of the interior reservoir 16, but it will be recognized that the tube 28 may alternatively extend to a position immediately inside the closure 26 or to any position between the bottom-most portion of the container 12 and the interior side of the closure 26. In the exemplary embodiment shown, that portion of the tube 28 extending exteriorly of the container 12 and closure 26 is bent to facilitate directing fluid dispensed from the container 12 to a desired location.

Bottle 10 further includes a valve-type nozzle 40 coupled to the outer end 34 of the tube 28 to further direct the flow of liquid from the reservoir 16, wherein the valve-type nozzle 40 communicates with reservoir 16 through the tube 28. Advantageously, the valve-type nozzle 40 has an open condition which permits the flow of liquid from the reservoir 16, through tube 28, and a closed condition wherein the flow of liquid through the tube 28 and valve 40 is prevented. In addition, the valve is adjustable to a continuous range of positions between fully opened and fully closed to permit adjustment in the flow of liquid during dispensing. In the exemplary embodiment shown, the valve-type nozzle 40 comprises first and second members 42, 44 which are coupled together to facilitate operation of the valve-type nozzle 40.

Figure 3:
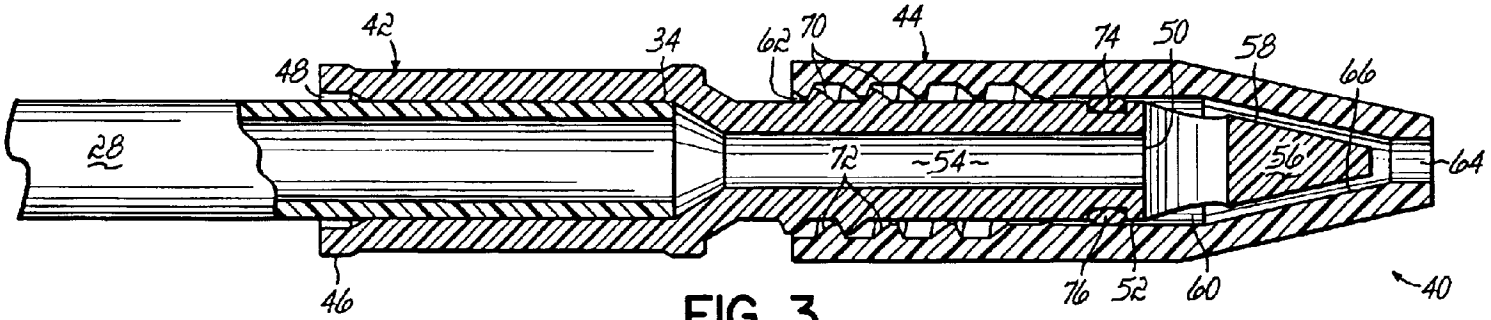
FIG. 3 is a cross-sectional view depicting an exemplary valve-type nozzle for the bottle of FIG. 1.

With continued reference to FIG. 2, and further reference to FIG. 3, the valve-type nozzle 40 will now be described in more detail. In the exemplary embodiment shown, the first member 42 is configured to be coupled to the outer end 34 of the tube 28. The second member 44 is configured to be coupled to the first member 42 and is manually adjustable with respect to the first member 42 to thereby place the valve-type nozzle 40 in the open condition or the closed condition, or a position in between. The first member 42 has an elongate tubular structure having an inner end 46 with an inlet port 48 sized to receive the outer end 34 of the tube 28 and an orifice 50 provided on an outer end 52 of the first member 42. The first member 42 further includes a first fluid passage 54 extending between the inlet port 48 and the orifice 50 whereby fluid from the reservoir 16, dispensed through the tube 28, may flow through the first fluid passage 54 to the orifice 50. A plug 56 proximate the outer end 52 of the first member 42 and spaced from the orifice 50 has a generally converging outer end 58, which cooperates with the second member 44 to selectively place the valve-type nozzle 40 in the open condition and the closed condition, and to vary the flow dispensed through the valve-type nozzle 40, as will be discussed more fully below.

The second member 44 of the valve-type nozzle assembly 40 has a generally elongate tubular shape with a second fluid passage 60 formed therethrough. The second fluid passage 60 has an inlet 62, an outlet 64, and a converging interior wall section 66 with a cross-sectional area which decreases toward the outlet 64 and corresponds, at least in part, with the converging outer end 58 of the plug 56 of the first member 42. Preferably, the length of the outlet 64 is approximately twice the diameter of the orifice of the outlet 64 to provide a stream of liquid and prevent sputtering. In the exemplary embodiment shown, the first member 42 has external threads 70 provided on a portion of the first member 42 which is received within the inlet 62 and second fluid passage 60 of the second member 44. External threads 70 engage corresponding internal threads 72 provided on the second member 44, whereby the first and second members 42, 44 may be threadably coupled together.

Figure 4A:
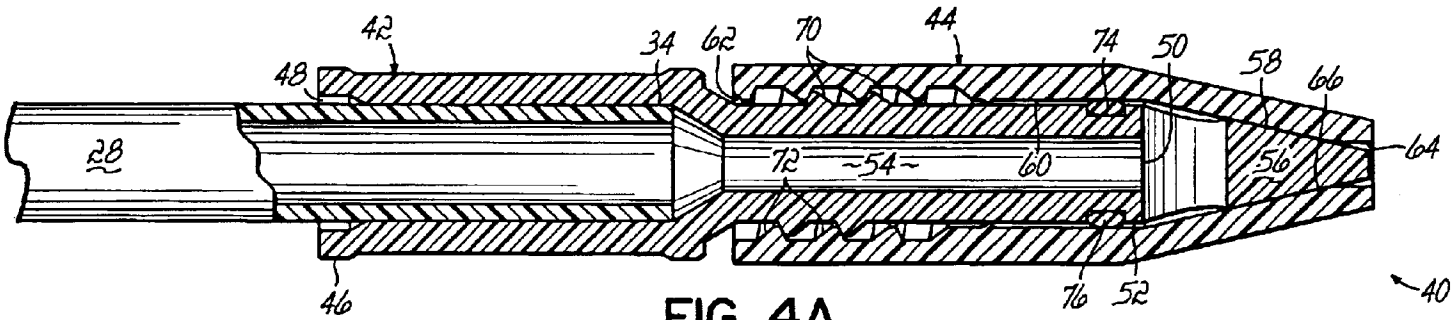
FIGS. 4A–4B are partial cross-sectional views of the valve-type nozzle of FIG. 3, illustrating various operating conditions of the valve-type nozzle.
Figure 4B:
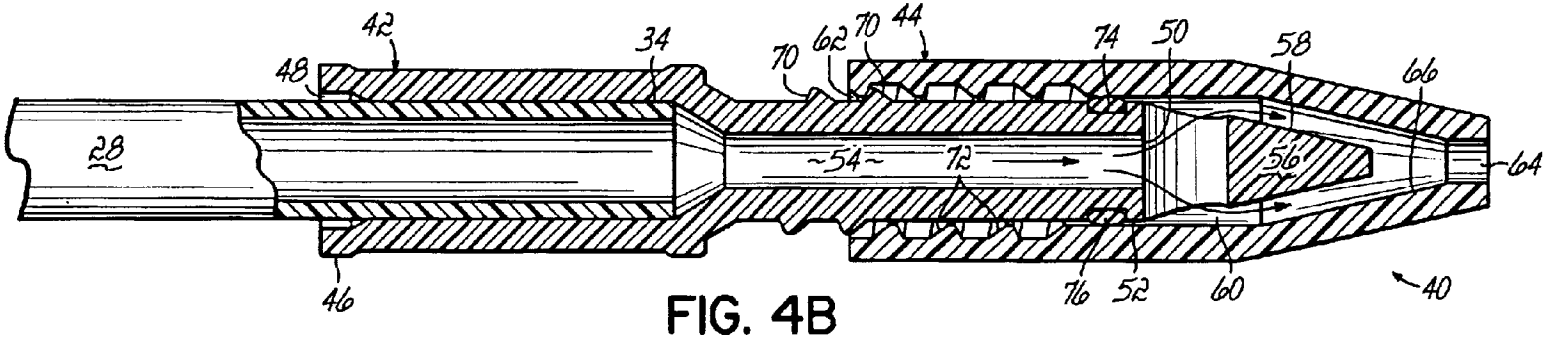

The relative positions of the first and second members 42, 44 may be adjusted by rotating the second member 44 with respect to the first member 42. Advantageously, the converging outer end 58 of the plug 56 of the first member 42 sealingly engages the converging interior wall section 66 of the second fluid passage 60 of the second member 44 when the valve-type nozzle 40 is placed in the closed condition to thereby prevent the flow of fluid through the valve-type nozzle 40. This closed condition is depicted more clearly in FIG. 4A. The first member 42 further includes a circumferential groove 74 proximate the outer end 52. An o-ring 76 disposed within the groove 74 is compressed between the first and second members 42, 44 to thereby seal the second fluid passage 60 behind the orifice 50 of the first member 42 when the first and second members 42, 44 are coupled together. Likewise, the second member 44 may be rotated with respect to the first member 42 to adjust the position of the second member 44 relative to the first member 42 to place the valve-type nozzle 40 in a fully opened condition, as depicted in FIG. 4B. In this condition, the converging outer end 58 of the plug 56 is spaced from the converging interior wall 66 of the second fluid passage 60 to provide an increased annular flow area for the fluid dispensed through the valve 40. The path of fluid flow along the first fluid passage 54, through outlet 50, and along the second fluid passage 60 is illustrated with arrows in FIG. 4B. Furthermore, the second member 44 may be rotated with respect to the first member 42 to place the second member 44 at a location relative to the first member 42 within a continuous range intermediate the fully opened and fully closed positions to provide infinitely variable annular flow area through which liquid flows through the valve-type nozzle 40. In this manner, the adjustable valve-type nozzle 40 permits the selective adjustment of liquid flow dispensed therefrom.

The bottle 10 may be used to store and dispense liquid by opening the valve-type nozzle 40 to a desired position and squeezing the flexible sidewalls 14 of the container 12 to force liquid stored in the interior reservoir 16 through the tube 28, through the first fluid passage 54 of the first member 42 of the nozzle assembly, through the orifice 50 of the first member 42, through the second fluid passage 60 and out the outlet 64 of the second fluid passage 60. In an exemplary embodiment, the bottle container 12 may be formed from fluoropolymer material resistant to solvents and other chemicals. The closure 26, valve-type nozzle 40, and tube 28 may also be formed from fluoropolymer material. This may be particularly useful when the tube 28 extends within the interior reservoir 16 of the container 12 where it will be in contact with solvents or other chemicals stored in the container 12.

Advantageously, the valve-type nozzle 40 may be placed in a closed condition, whereby the bottle 10 of the present invention may be used to store volatile, aggressive and/or high-purity solvents and to prevent the unwanted leakage of the liquid due, for example, to vapor pressure generated within the bottle 10, or tipping of the bottle 10. In this embodiment, the bottle 10 further includes a vent 80 for relieving the vapor pressure created by the volatile liquid stored within the container 12. Vent 80 comprises a vent port 82 in communication with the interior reservoir 16 and configured to receive a gas permeable membrane plug 84 through which the vapor pressure within the container 12 may be relieved. The membrane plug 84 is substantially impermeable to liquids to prevent unwanted leakage of the liquid material stored therein if the bottle 12 is inadvertently placed on its side. The membrane plug 84 comprises a plug formed from a fluoropolymer and which is porous to solvent vapors, yet resistant to solvents or other chemical liquids that may be stored in the container 12. Such a plug is available from Porex Corporation, Faiburn, Ga., as a microporous PTFE membrane. While vent 80 is shown and described herein integrated with closure 26, it will be recognized that vent 80 may alternatively be located at other positions or on other components of the bottle 10 to provide communication between reservoir 16 and the exterior of container 12.

The exemplary bottle 10 of the present invention further includes a tag 90 which may be coupled to the container 12 to indicate the contents of the container 12. The tag 90 is particularly useful when the container 12 is formed from fluoropolymer material, which is generally difficult to mark with inks or adhesive labels. In the exemplary embodiment shown, the tag 90 is of a unitary construction, including a marking member 92 and a connecting member 94. The marking member 92 comprises a generally arcuate surface configured to mate with the contours of the container 12 and is formed from a material which is adapted to receive inks or adhesive labels thereupon. For example, the marking member 92 may be formed from polypropylene or any other material suitable for marking with ink or receiving an adhesive label. Preferably, the tag 90 is formed in different colors in conformance to industry standards. The connecting member 94 comprises a retaining ring configured to snap-fit over the retaining lip or collar 24 of the container 12, whereby the tag 90 may be securely held on the container 12 even after the closure 28 has been removed from the container 12.

The present invention thus provides a bottle 10 for storing, identifying, and dispensing liquid materials, particularly volatile, aggressive, and/or high-purity solvents and chemicals, and which has a unique valve-type nozzle and vent and a novel tag for labeling purposes. The valve-type nozzle 40 can be selectively placed in an opened or closed position, or adjusted to vary the flow of liquid material dispensed through the valve-type nozzle 40. The valve-type nozzle 40 is used in conjunction with a vent 80 for relieving vapor pressure created by storing volatile liquids within the container 12. The bottle 10 is durable to meet the demands of use in a wide range of environments, and may be sterilized, such as by autoclaving if desired.

While the present invention has been illustrated by the description of the various exemplary embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A bottle for storing and selectively dispensing liquid in a stream, comprising:

a container having flexible side walls enclosing an interior reservoir, and having a first open end providing access to said reservoir;

a closure selectively removably coupled to said container proximate said open end such that said reservoir is selectively accessible for filling and refilling, said closure having an aperture;

a vent port in communication with said reservoir;

a gas-permeable, substantially liquid impermeable membrane disposed within said vent port;

an elongate tube having an inner end communicating with said reservoir and an outer end located exteriorly of said container and closure, said tube being inserted into said closure aperture and sealed with respect thereto; and a valve-type nozzle coupled to said outer end of said tube in fluid communication with said reservoir, said valve-type nozzle having an open condition to permit the flow of liquid from said reservoir through said valve-type nozzle and a closed condition to prevent the flow of liquid through said valve-type nozzle from said reservoir, said nozzle operable between open and closed conditions independently of flow from said reservoir.

2. The bottle of claim 1, wherein said container is formed from a fluoropolymer.

3. The bottle of claim 2, wherein at least one of said closure, said valve-type nozzle, and sold tube are formed from fluoropolymer material.

4. The bottle of claim 1, wherein said valve-type nozzle is selectively variably adjustable between said open condition and said closed condition to selectively variably adjust the flow of liquid therethrough.

5. The bottle of claim 1, wherein said membrane comprises a porous plug formed from a fluoropolymer.

6. The bottle of claim 1, wherein said valve-type nozzle comprises:

a first member coupled to said outer end of said tube, and a second member coupled to said first member for selective relative movement with respect thereto, to selectively place the valve-type nozzle in one of an open condition and a closed condition;

said first member having inner and outer ends, and a first fluid passage therein, with an inlet port at the inner end thereof in fluid communication with said outer end of said tube, said first fluid passage having an orifice at the outer end thereof, whereby liquid from said reservoir can flow through said outer end of said tube, said inlet port, said first fluid passage, and said orifice, said first member further having a plug, which has a converging outer end, said plug located outwardly of said orifice and spaced therefrom;

said second member having a second fluid passage therein, said second fluid passage having an inlet, an outlet, and a converging interior wall section with a flow cross-sectional area which decreases toward said outlet, said second fluid passage inlet configured to receive therein said orifice of said first member;

selective relative movement of said first and second members being operative to move said converging outer end of said plug into sealing engagement and unsealing engagement with said converging interior wail section of said second fluid passage, to selectively place said valve-type nozzle into closed and open conditions, respectively;

whereby when said valve-type nozzle is placed in its open condition, liquid flowing out of said orifice is directed along said converging interior wall section of second fluid passage and discharges from said second fluid passage outlet of said valve-type nozzle, and when said valve-type nozzle is placed in its closed position, said converging outer plug end seals against said converging wall section of said second flow path to prevent liquid flow through said valve-type nozzle.

7. The bottle of claim 6, wherein said first and second members are further selectively variably movable relative to one another to vary the flow rate through said valve-type nozzle when said valve-type nozzle is placed in said open condition.

8. The bottle of claim 7, wherein said first and second members each further comprise cooperating threaded structure configured to threadably couple said first and second members for selective relative movement to thereby selectively variably adjust the flow rate through said nozzle assembly.

9. The bottle of claim 1, further comprising a tag configured to be coupled to said container to identify the contents of said container.

10. The bottle of claim 9, wherein said container includes a retaining ring proximate said first open end and said tag is configured to engage said retaining ring to thereby couple said tag to said container proximate said first open end.

11. The bottle of claim 9, wherein said tag is formed from polypropylene.

12. The bottle of claim 9, wherein said tag is formed from colored material.

13. A bottle comprising:

a container having flexible side walls enclosing an interior reservoir, a first open end providing access to said reservoir, and a retaining ring proximate said first open end;

a closure selectively coupled to said container body proximate said open end, said closure having an aperture, a vent port in communication with said reservoir;

a gas-permeable, substantially liquid impermeable porous plug disposed within said vent port, said porous plug formed from a fluoropolymer;

an elongate tube having an inner end communicating with said reservoir and an outer end located exteriorly of said container end closure, said tube being inserted into said closure aperture and sealed with respect thereto;

a valve-type nozzle coupled to said outer end of said tube in fluid communication with said reservoir, said valve-type nozzle having an open condition to permit the flow of liquid from said reservoir through said valve-type nozzle and a closed condition to prevent the flow of liquid through said valve-type nozzle from said reservoir; and a tag configured to engage said retaining ring to thereby couple said tag to said container proximate said first open end.

14. The bottle of claim 13, wherein said container is formed from a fluoropolymer.

15. The bottle of claim 13, wherein said valve-type nozzle comprises;

a first member coupled to said outer end of said tube, and a second member coupled to said first member for selective relative movement with respect thereto, to selectively place the nozzle assembly in one of an open condition and a closed condition;

said first member having inner and outer ends, and a first fluid passage therein, with an inlet port at the inner end thereof in fluid communication with said outer end of said tube, said first fluid passage having an orifice at the outer end thereof, whereby liquid from said reservoir can flow through said outer end of said tube, said inlet port, said first fluid passage, and said orifice, said first member further having a plug, which has a converging outer end, said plug located outwardly of said orifice and spaced therefrom;

said second member having a second fluid passage therein, said second fluid passage having an inlet, an outlet, and a converging interior wall section with a flow cross-sectional area which decreases toward said outlet, said second fluid passage inlet configured to receive therein said orifice of said first member;

selective relative movement of said first and second members being operative to move said converging outer end of said plug into sealing engagement and unsealing engagement with said converging interior well section of said second fluid passage, to selectively piece said valve-type nozzle into closed and open conditions, respectively;

whereby when said valve-type nozzle is placed in its open condition, liquid flowing out of said orifice is directed along said converging interior wall section of second fluid passage and discharges from said second fluid passage outlet of said valve-type nozzle, and when said valve-type nozzle is placed in its closed position, said converging outer plug end seals against said converging wall section of said second flow path to prevent liquid flow through said valve-type nozzle.

16. A bottle for storing and selectively dispensing liquid in a stream, comprising:

a container having flexible side walls enclosing an interior reservoir, and having a first open end providing access to said reservoir;

a closure selectively coupled to said container proximate said open end, said closure having an aperture;

a vent port in communication with said reservoir;

a gas-permeable, substantially liquid impermeable membrane disposed within said vent port;

an elongate tube having an inner end communicating with said reservoir and an outer end located exteriorly of said container end closure, said tube being inserted into said closure aperture and sealed with respect thereto; and a valve-type nozzle coupled to said outer end of said tube in fluid communication with said reservoir, said valve-type nozzle having an open condition to permit the flow of liquid from said reservoir through said valve-type nozzle and a closed condition to prevent the flow of liquid through said valve-type nozzle from said reservoir;

said valve-type nozzle independently, selectively variably adjustable between said open condition and said closed condition to selectively variably adjust the flow of liquid therethrough;

said nozzle configured such that once adjusted, said nozzle maintains said adjusted condition until manually readjusted from said adjusted condition.

17. A bottle for storing and selectively dispensing liquid in a stream, comprising:

a container having flexible side walls enclosing an interior reservoir, and having a first open end providing access to said reservoir;

a closure selectively coupled to said container proximate said open end, said closure having an aperture;

a vent port in communication with said reservoir;

a gas-permeable, substantially liquid impermeable membrane disposed within said vent port;

an elongate tube having an inner end communicating with said reservoir and an outer end located exteriorly of said container and closure, said tube being inserted into said closure aperture and sealed with respect thereto; and a valve-type nozzle coupled to said outer end of said tube in fluid communication with said reservoir, said valve-type nozzle having an open condition to permit the flow of liquid from said reservoir through said valve-type nozzle and a closed condition to prevent the flow of liquid through said valve-type nozzle from said reservoir;

wherein said valve-type, nozzle comprises:

a first member coupled to said outer end of said tube, and a second member coupled to said first member for selective relative movement with respect thereto, to selectively place the valve-type nozzle in one of an open condition and a closed condition, said first member having inner and outer ends, and a first fluid passage therein, with an inlet port at the inner end thereof in fluid communication with said outer end of said tube, said first fluid passage having an orifice at the outer end thereof, whereby liquid from said reservoir can flow through said outer end of said tube, said inlet port, said first fluid passage, and said orifice, said first member further having a plug, which has a converging outer end, said plug located outwardly of said orifice and spaced therefrom, said second member having a second fluid passage therein, said second fluid passage having an inlet, an outlet, and a converging interior wall section with a flow cross-sectional area which decreases toward said outlet, said second fluid passage inlet configured to receive therein said orifice of said first member, selective relative movement of said first and second members being operative to move said converging outer end of said plug into sealing engagement and unsealing engagement with said converging interior wall section of said second fluid passage, to selectively place said valve-type nozzle into closed and open conditions, respectively, whereby when said valve-type nozzle is placed in its open condition, liquid flowing out of said orifice is directed along said converging interior wall section of second fluid passage and discharges from said second fluid passage outlet of said valve-type nozzle, and when said valve-type nozzle is placed in its closed position, said converging outer plug end seals against said converging wall section of said second flow path to prevent liquid flow through said valve-type nozzle;

wherein said first and second members are further selectively variably movable relative to one another to vary the flow rate through said valve-type nozzle when said valve-type nozzle is placed in said open condition; and wherein said first and second members each further comprise cooperating threaded structure configured to threadably couple said first and second members for selective relative movement to thereby selectively variably adjust the flow rate through said nozzle assembly.

18. A bottle for storing and selectively dispensing liquid in a stream, comprising:

a container having flexible side walls enclosing en interior reservoir, and having a first open end providing access to said reservoir;

a closure selectively coupled to said container proximate said open end, said closure having an aperture;

a vent port in communication with said reservoir;

a gas-permeable, substantially liquid impermeable membrane disposed within said vent port;

an elongate tube having an inner end communicating with said reservoir and an outer end located exteriorly of said container and closure, said tube being inserted into said closure aperture and sealed with respect thereto;

a valve-type nozzle coupled to said outer end of said tube in fluid communication with said reservoir, said valve-type nozzle having an open condition to permit the flow of liquid from said reservoir through said valve-type nozzle and a closed condition to prevent the flow of liquid through said valve-type nozzle from said reservoir; and a tag configured to be coupled to said container to identify the contents of said container;

wherein said container includes a retaining ring proximate said first open end and said tag is configured to engage said retaining ring to thereby couple said tag to said container proximate said first open end.

* * * * *

UNITED STATES PATENT AND TRADEMARK OFFICE

CERTIFICATE OF CORRECTION

PATENT NO. : 6,837,400 B2
DATED : January 4, 2005
INVENTOR(S) : Leoncavallo et al.

It is certified that error appears in the above-identified patent and that said Letters Patent is hereby corrected as shown below:

Column 6,
Line 54, reads "...said valve-type nozzle, and sold tube…" and should read -- ...said valve-type nozzle, and said tube… --.

Column 7,
Line 23, reads, "...converging interior wail section of…" and should read -- ...converging interior wall section of… --.

Column 8,
Line 18, reads, "...said valve-type nozzle comprises;…" and should read -- ...said valve-type nozzle comprises:… --.
Lines 44-45, reads "...said converging interior well section of...to selectively piece said valve-type nozzle into…" and should read -- ...said converging interior wall section of...to selectively place said valve-type nozzle into… --.

Column 9,
Line 42, reads "...wherein said valve-type, nozzle comprises:" and should read -- ...wherein said valve-type nozzle comprises: --.

Column 10,
Line 34, reads "...enclosing en interior reservoir, and…" and should read -- ...enclosing an interior reservoir, and… --.

Signed and Sealed this

Thirtieth Day of August, 2005

JON W. DUDAS
*Director of the United States Patent and Trademark Office*